United States Patent [19]

Vlček et al.

[11] 4,088,226

[45] May 9, 1978

[54] PORTABLE FACILITIES FOR AUTOMATICALLY COLLECTING AND SORTING WOUND SPOOLS FROM OPEN-END SPINNING MACHINES

[75] Inventors: Karel Vlček, Okres Trutnov; Zdena Pacáková, Cerveny Kostelec; Bohuslav Jirka, Upice; Bedřich Česenek, Okres Nachod; Karel Jindra, Cerveny Kostelec, all of Czechoslovakia

[73] Assignee: Elitex, koncern textilniho strojirenstvi, Liberec, Czechoslovakia

[21] Appl. No.: 723,939

[22] Filed: Sep. 16, 1976

[30] Foreign Application Priority Data

Sep. 22, 1975 Czechoslovakia ..... 6374-75

[51] Int. Cl.[2] ..... B07C 5/04

[52] U.S. Cl. ..... 209/82; 209/73; 198/477; 198/482; 198/651; 198/680

[58] Field of Search ..... 209/72, 73, 74 R, 82; 198/477, 474, 482, 484, 489, 651, 678, 680

[56] References Cited

U.S. PATENT DOCUMENTS

| | | | |
|---|---|---|---|
| 2,787,373 | 4/1957 | Rehberg | 209/72 |
| 3,606,012 | 9/1971 | Brouwer | 209/73 |
| 3,935,821 | 2/1976 | Maier et al. | 198/678 X |
| 3,946,884 | 3/1976 | Kato et al. | 198/651 X |
| 3,966,591 | 6/1976 | Hinton et al. | 209/73 |

*Primary Examiner*—Robert B. Reeves
*Assistant Examiner*—Joseph J. Rolla

[57] ABSTRACT

A portable device for collecting and automatically sorting wound spools from open-end spinning machines is described. The device includes an entry chute that cooperates with the outlet end of a conveyor on the top of the spinning machine for guiding each spool into a wedge-shaped classifying guide, which directs each spool into an auxiliary storage magazine or onto a conveyor in accordance with the overall diameter of the spools. The spools directed to the conveyor are guided in the device onto a second conveyor, which moves in a horizontal path above a movable platform, from which extend a plurality of spool-receiving receptacles. Facilities are associated with the second conveyor for successively receiving classified spools from the first conveyor and for releasing the spools seriatim onto the underlying receptacles. When the spools are completely emptied from the spinning machine, the movable platform loaded with the collected spools can be taken out of the sorting device, while the rejected spools can be emptied from the auxiliary magazine.

10 Claims, 18 Drawing Figures

PORTABLE FACILITIES FOR AUTOMATICALLY COLLECTING AND SORTING WOUND SPOOLS FROM OPEN-END SPINNING MACHINES

BACKGROUND OF THE INVENTION

The invention relates to facilities for collecting and sorting wound spools from open-end spinning machines.

In known arrangements of this type, spools of yarn collected at the output of an open-end spinning machine are moved along a conveyor on the spinning machine to an exit point, where they are dropped into a collecting chute in an unsorted manner. A disadvantage of this arrangement is the time-consuming and expensive manual labor necessary for emptying the spools from the receptacle and sorting the emptied spools into categories, i.e., an acceptable category wherein the outer diameter of the wound spools is above a predetermined value, and an unacceptable category wherein the outer diameter is below the threshold value.

SUMMARY OF THE INVENTION

The present invention relates to an automatic spool-collecting and sorting device which eliminates the above-mentioned disadvantages.

In an illustrative embodiment, a wheeled receptacle is movable along a path opposite the exit points of one or more open-end spinning machines or similar textile machines. A sloped entry chute receives successive wound spools from the exit point of each machine, and routes it via a guiding edge to a wedge-shaped classifier that is disposed transversely of the guiding edge. Spools having a diameter below the above-mentioned threshold value move inertially to one side of the wedge and into an auxiliary magazine for temporary storage, while the remaining (acceptable) spools are moved along a first conveyor to an inertial positioning device at its output end, which transfers each successive acceptable spool onto an inlet point of a second conveyor.

A plurality of pivotally mounted, spool-gripping projections at spaced points of the second conveyor pick up the spools at the inlet point thereof and move it to an exit point, whereby an eccentrically-mounted pair of swingable arms lift each spool onto an overlying jaw.

A plurality of such jaws are carried at spaced points of a third conveyor, which moves in a predetermined path past each of a succession of underlying spool-engaging receptacles that extend upwardly from an auxiliary support floor movably carried in the main sorting receptacle. A first operating lever connected to each jaw engages a release arm fixedly positioned in the path of movement of the third conveyor above each of the upwardly extending receptacles, thereby moving the lever into a position effective to actuate the jaw to discharge the engaged spool onto the receptacle.

In order to condition the jaws for a succeeding cycle of pickup and release of spools, a second lever positioned behind the first lever of each jaw is operated, preferably after a spool has been dropped onto each receptacle sticking up from the mobile platform, to reset the release means in the path of movement of the third conveyor.

After all the wound spools have been transferred from the textile machines onto the main wheeled enclosure and routed either to the auxiliary magazine or onto the receptacles on the moving platform, the platform may be removed from the enclosure for further processing, and the auxiliary magazine with the rejected spools may be emptied.

BRIEF DESCRIPTION OF THE DRAWING

The invention is further set forth in the following detailed description taken in conjunction with the appended drawing, in which.

DETAILED DESCRIPTION

Figure 17:
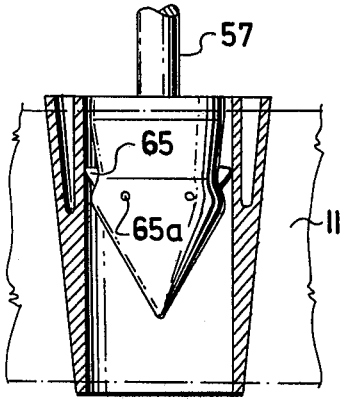
FIG. 17 is an illustration of the cooperation between the jaws of FIG. 10 and the interior of a wound spool of conical design.

Referring now to the drawing, the numerals **1*a*, 1*b* and 1*c* refer to conventional, open-ended spinning machines which are arranged in spaced relation along a path parallel to a pair of guide tracks 4. Each of such spinning machines has, on its upper end, a conveyor 2**, which is advanced by suitable means not shown around a guide roller 3 for conveying a plurality of spools 15, such spools having disposed thereon a winding 11 of yarn derived from the spinning chamber (not shown) of the associated machine 1. The spool 15 is generally cylindrical in shape, but may also have a conical taper (FIG. 17).

The successive spools on each conveyor 2 are moved to an exit point 500 above the guide roller 3, such exit point confronting an entry chute 16 of a portable spool collecting and sorting device 6 constructed in accordance with the invention when such device 6 is moved past such machine along the tracks 4.

Figure 2:
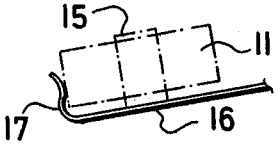
FIG. 2 is a detail view of an entry chute construction suitable for use in the arrangment of FIG. 1.

The chute 16 is sloped downwardly along its length from an inlet point opposite the conveyor exit point 500 to a sorting section 18 disposed in the collecting and sorting device 6 (hereafter referred to for simplicity as the "servicer 6"). As shown in FIG. 2, the chute 16 is also sloped downwardly in a plane perpendicular to its length, so that spools entering the chute 16 are slid downwardly toward a lower guiding edge 17, which engages the outer periphery of the yarn winding 11.

Figure 3:
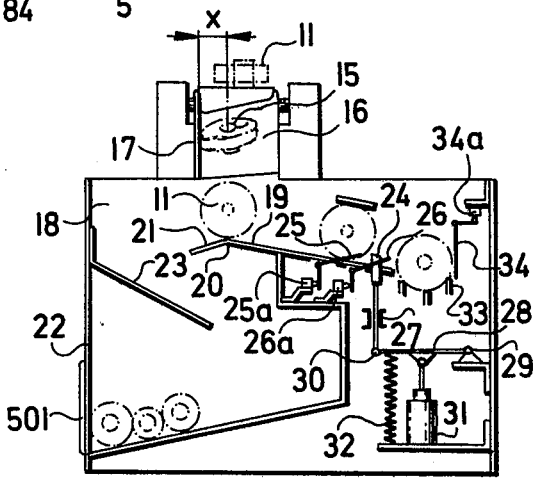
FIG. 3 is an elevation view, taken along line 3—3 of FIG. 1, illustrating the structure and manner of operation of the classifying means in the arrangement of FIG. 1.

Referring to FIG. 3, each spool 15 reaching the outlet end of the inclined chute 16 is dropped onto a generally wedge-shaped guiding edge 20 in the servicer sorting portion 18. The guiding edge 20 is positionable to a suitable transverse spacing X from the guiding edge 17 of the chute 16. For any such given spacing X, wound spools 15 having an overall wound radius less than X will drop onto the edge 20 with their center of gravity displaced to the left as viewed in FIG. 3, while incoming wound spools having a wound radius greater than X will flow onto the edge 20 with its center of gravity to the right of such edge as viewed in the drawing. Spools of the first type, which may arbitrarily be considered in the "unacceptable" category, will be moved along a chute 21 disposed at the left of the edge 20 to drop onto a slide 23, and from there into an auxiliary magazine 22. A door 501 is positioned on the side of the servicer 6 for emptying the unacceptable spools from the magazine 22 when desired.

The remaining of "acceptable" wound spools 15 are guided from the edge 20 to a first conveyor 19, in the form of a chute, which is connected to and disposed on the right side of the guiding edge 20.

The wound spools moving down the conveyor 19 are selectively blocked by a movable escapement member 24, which protrudes upwardly through the floor of the chute 19. The escapement member 24 is movable out of blocking relation to the wound spool 5 upon operation of an electromagnet 31, which when actuated moves a lever 28, which is pivoted at 29 and which is connected to the member 24, against the force of a spring 32. The electromagnet 31 is adapted to be normally operated upon the closure of contact of a limit switch 25*a*, which will occur upon the rolling movement of a wound spool 5 over a feeler 25 in engagement with the switch 25*a*.

In the event that, due to some malfunction, one of the wound spools 15 has not yet moved past the escapement mechanism 24 by the time that a succeeding spool has entered the chute 19, the retarded spool will contact a second sensor 26 associated with a limit switch 26*a* at the time that the next-succeeding spool contacts the sensor 25. The switch 26*a* is arranged in a conventional manner to inhibit operation of the electromagnet 31, so that a queueing of the spools will cause the escapement member 24 to remain in its blocking position; in such circumstances, the associated circuitry may be connected with a suitable alarm to summon an attendant.

Figure 4:
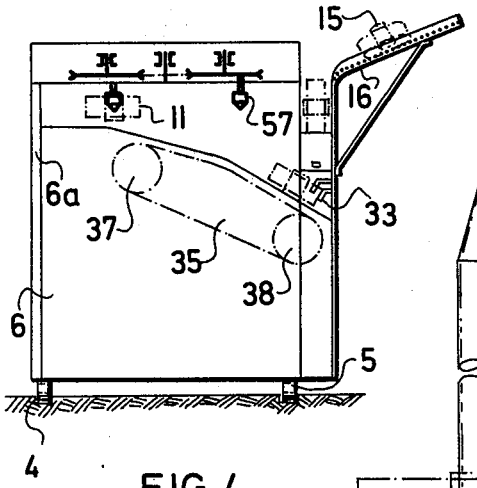
FIG. 4 is a right side view, partially in schematic form, of the arrangement of FIG. 1.

When the escapement mechanism is working properly, each successive wound spool drops from the outlet point of the chute 19 onto an inertial transfer mechanism consisting of a plurality of pin-like supports 33, which are swingable as a unit from a point opposite the outlet point of the chute 19 to an inlet point above a driven roller 38 (FIGS. 4 and 5) of a transfer conveyor 35. The inertial device 33 is so associated with an additional sensor 34 (FIG. 3), that in the event a spool 15 has not yet been transferred from the inertial device 33 to the inlet of the transfer conveyor, the outer periphery of the winding 11 on such spool will contact the sensor 35 to actuate a microswitch 34*a*, which is suitably adapted to inhibit operation of the electromagnet 31. Accordingly, the escapement mechanism 24 will be maintained in its spool-blocking position until the inertial device 33 has transferred its contents to the transfer conveyor 35 (FIGS. 4 and 5).

Figure 5:
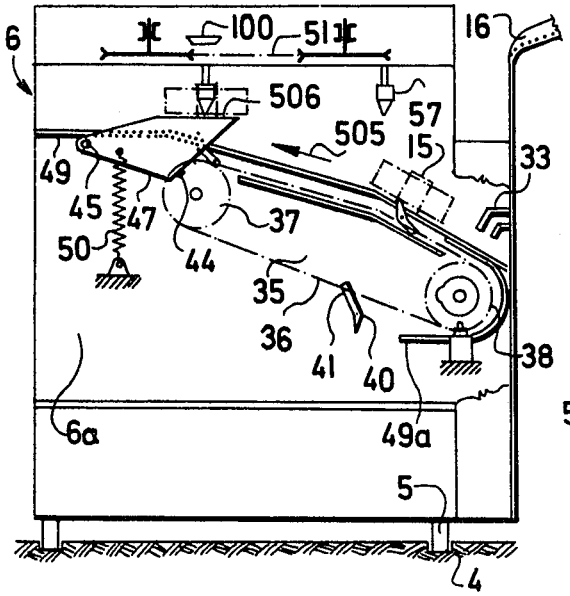
FIG. 5 is a right side view, similar to FIG. 4, but with a portion thereof cut away to indicate details of an intermediate transfer conveyor within the arrangement.
Figure 6:
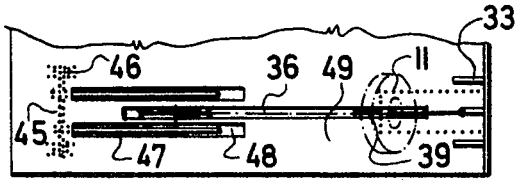
FIG. 6 is a fragmentary plan view of the arrangement of FIG. 5.

As shown best in FIG. 5, the transfer conveyor 35 is disposed within a main housing portion 6*a* of the servicer 6, such housing portion also serving to rotatably support a plurality of rollers 5, by means of which the servicer 6 can be moved along the guide tracks 4.

The conveyor 35 includes an endless belt 36 which moves around the driven roller 38 and a drive roller 37 in such a manner that, in its upper position, the belt 36 moves diagonally upward in the direction of an arrow 505. The upper portion of the belt 36 in the vicinity of the drive roller 37 is straddled by a pair of openings 48 in an inclined platform 49, which at its lower end extends generally parallel to the belt 36. A pair of lifting arms 47, supported on a pivot pin 45 carried in a sleeve 46, are disposed in the respective openings 48 for movement, when actuated as indicated below, between a retracted position within the openings 48 to an extended position projecting above the openings 48 against the restraining force of a tension spring 50.

A plurality of elongated, spool-engaging elements 40 are supported on pivot pins 41 disposed at axial spaced locations along the endless belt 36. Typically, the elements 40 are movable from a normal extended position shown in FIG. 5 to a retracted position at or below the plane of the belt 36 as each of the elements 40 contact a planar limit plate 49*a* supported on the lower end of the platform 49. In particular, the successive elements 40, proceeding counterclockwise around the driven roller 38, are maintained in their retracted position until they reach the conveyor inlet point directly below the swingable inertial tilting element 33, at which point they are free to extend to grip the interior of the spool 15 of the then-introduced winding.

Each so-captured spool 15 is thereafter moved upwardly in the direction of the arrow 505 until such spool is disposed over upper surfaces 506 of the still-retracted lifting arm 47, at which point an eccentric pin 44 carried on the driving pulley 37 actuates the arms 47 to lift the then-engaged spool 15 to be captured by a then-overlying one of a plurality of jaws 57 carried on an overlying conveyor 51.

Figure 1:
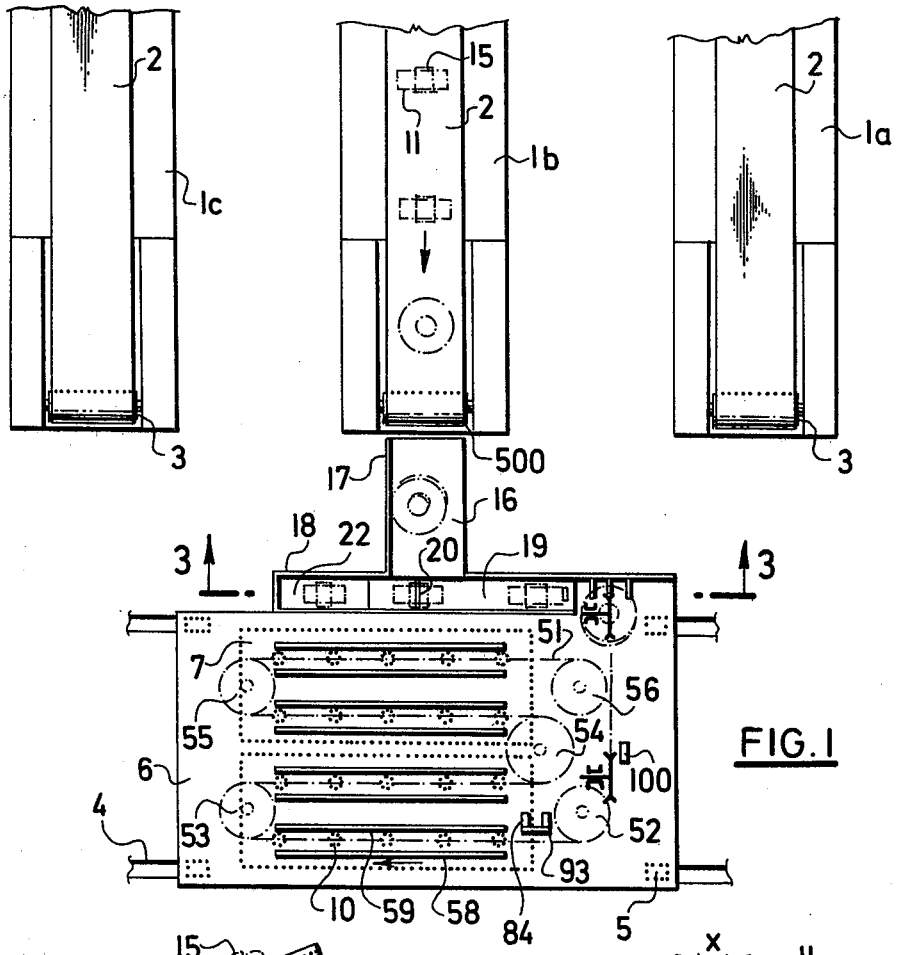
FIG. 1 is a plan view of a portable arrangement constructed in accordance with the invention for automatically collecting and classifying wound spools from a plurality of open-ended spinning machines.
Figure 9:
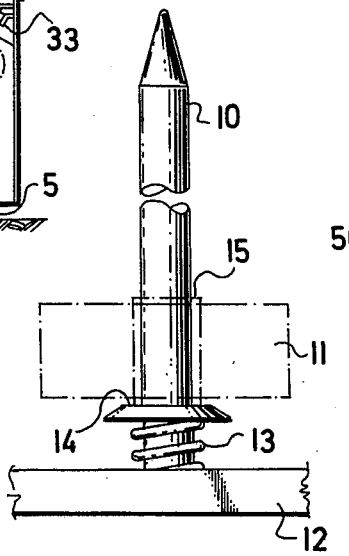
FIG. 9 is a detail view of a spool-receiving receptacle supported on the movable platform of FIGS. 7–8.
Figure 7:
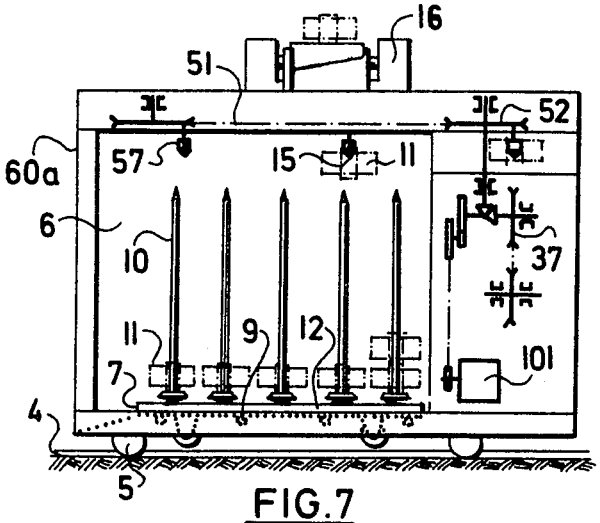
FIG. 7 is a front elevation of the portable arrangement of FIG. 1, illustrating details of a movable platform supported within an overall portable enclosure and including a plurality of spool-receiving receptacles extending upwardly therefrom.
Figure 8:
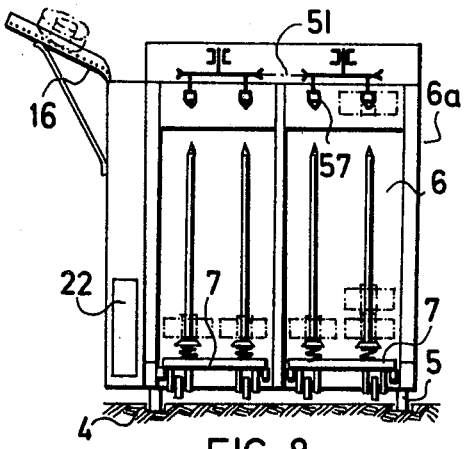
FIG. 8 is a side view of the arrangement of FIG. 7.

As shown best in FIG. 1, the conveyor 51, which may be embodied by a sequence of chain links, proceeds in a serpentine path in engaging relation with a drive roller 52 and a plurality of guide rollers 53–56. The path of the conveyor 51 extends in superposed relation to the upper ends of a plurality of spool-receiving receptacles 10, which are in the shape of elongated rods and which, as best shown in FIGS. 7–8, extend upwardly from a wheeled platform 7, which is movably supported in the housing portion 6a of the servicer 6. Illustratively, the rods 10 are laid out in a rectangular array. As shown in FIG. 9, each rod 10 is resiliently affixed by a spring 13 to the bottom wall 12 of the platform 7, such spring supporting a contact plate 14 upon which the bottom surface of the spool 15 and the winding 11 abut when the spool is received by the rod 10.

Figure 11:
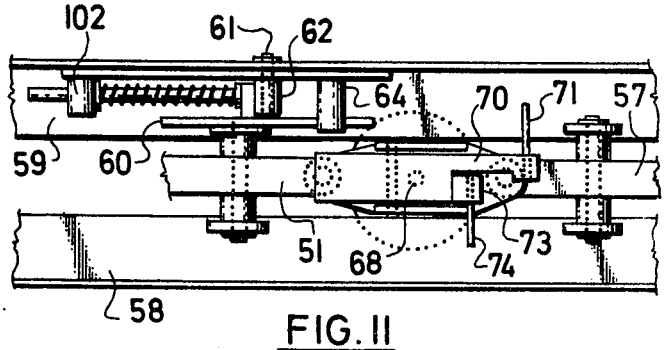
FIG. 11 is a plan view of the arrangement of FIG. 10.
Figure 12:
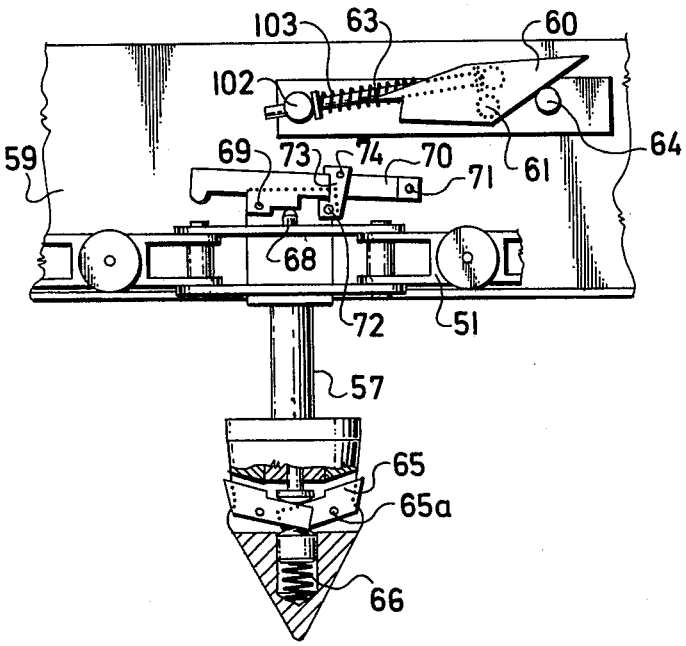
FIG. 12 is an elevation view, similar to FIG. 10, showing the jaw-operating portion in its operating position.

The conveyor 51 is provided with suitable facilities for releasing a wound spool 15 from each of the successive jaws 57 and onto an overlying one of the rods 10 in seriatim fashion. For this purpose, a plurality of releasing elements 60 (FIG. 10) are fixedly disposed in the path of the conveyor 51, such releasing elements being individually associated with and positioned directly over the successive rods 10. Each releasing element cooperates with an operating pressure lever 70 that is mounted on a pivot pin 69 of the jaw assembly 57, being actuable from a normal inoperative position shown in FIG. 10 to an operated position shown in FIG. 12. In the inoperative position, the lever 70 is biased in a counterclockwise direction by the force of a spring-loaded pawl 73 supported on a pivot 72. When operated, the lever 70 moves clockwise to move a tie rod 68 associated with the jaw assembly 57 downwardly, which action is effective to retract a pair of normally extending jaw elements 65, 65a against the force of an underlying spring 66, thereby releasing the grip of the jaw assembly 57 on the inside surface of the captured spool 15, whereby the spool can drop down over the underlying rod 10 (FIG. 1). Once the jaws are retracted into the position shown in FIG. 12, they are held there by the pawl 74 until the latter is released by a stop 100 (FIG. 5), which in turn is operated when the lifting arms 47 raise the captured spool into operative position over the jaw member 57. The release element 60 (FIG. 10) is embodied as a plate which is supported on a central pivot pin 61, and which is normally biased in a counterclockwise direction against a stationary support pin 64 by means of a resilient support 63 including a spring 103 mounted on a pivot 102. In its biased position, the right end of the element 60 as viewed in FIG. 10 includes a detent 60a which is in alignment with a control pin 71 (FIG. 11) affixed to the operating lever 70. As the conveyor 51 advances to the left as viewed in the figure, the control pin 71 engages the detent 60a, which imparts a clockwise movement to the lever 70 about its pivot pin 69 so that the lever reaches the operated position shown in FIG. 12. The contact force between the detent and the control pin also causes the release element 60 to move clockwise against the force of the spring 103 to a second end position shown in FIG. 12, wherein the detent 60a is out of the path of movement of the control pin 71 of the next-succeeding jaw member 57. Instead, such jaw member will proceed until it engages the release member 60 above the next rod 10 in the array of FIGS. 7 and 8, and so forth; in this way, the wound spools captured by the jaw assembly 57 release their loads seriatim onto the successive rods 10.

Figure 10:
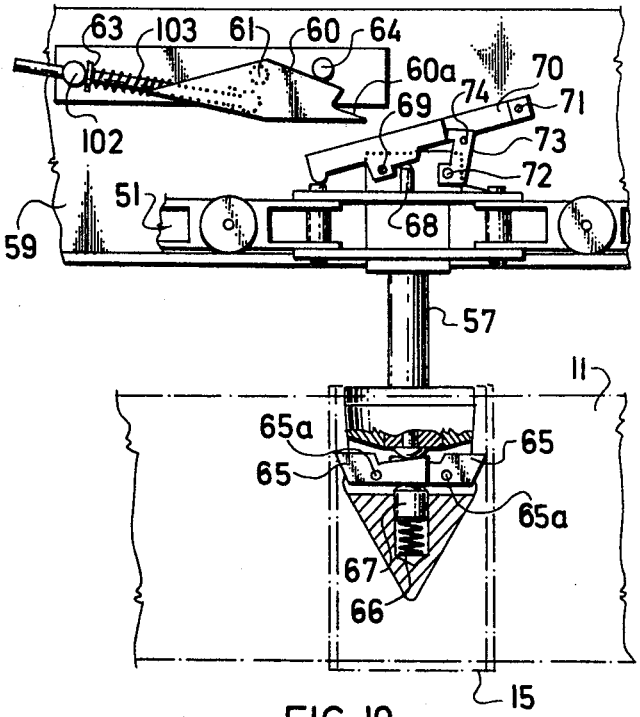
FIG. 10 is an enlarged elevation view of a jaw-carrying portion of an additional conveyor within the portable arrangement of FIG. 1, illustrating details of a jaw operating mechanism therein.
Figure 13:
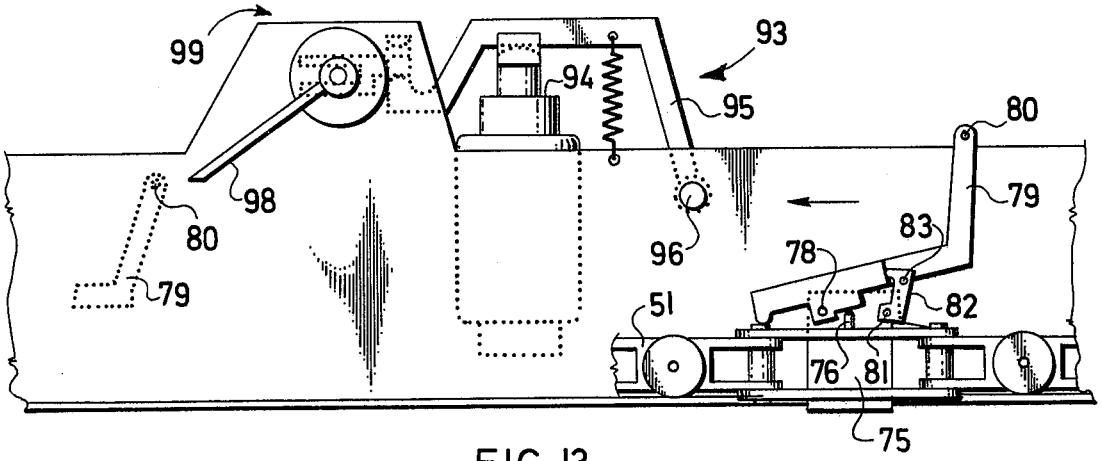
FIG. 13 is an elevation view of a portion of the conveyor of FIG. 12, illustrating a resetting lever positioned behind each of the jaws of FIG. 10 in an unoperated position.
Figure 16:
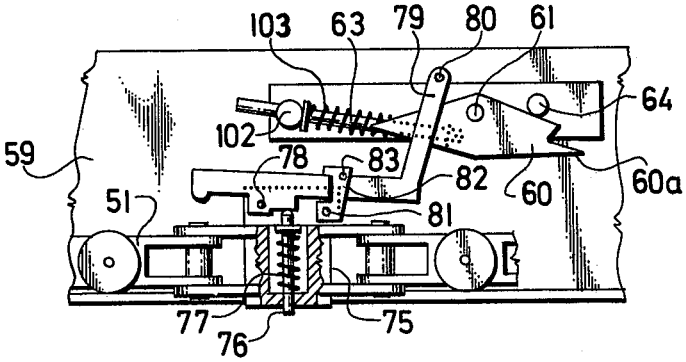
FIG. 16 is an elevation view, similar to FIG. 14, but illustrating the operated resetting means after engagement with the release means.
Figure 14:
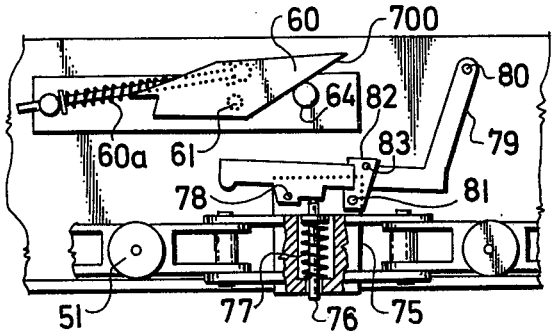
FIG. 14 is an elevation view of the resetting arrangement of FIG. 13, after being operated into a resetting position and prior to its engagement with a fixed release member associated with each of the upwardly extending receptacles of FIGS. 7–9.
Figure 15:
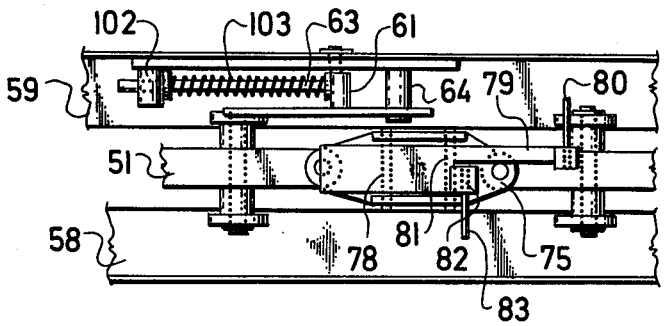
FIG. 15 is a plan view of the arrangement of FIG. 14.

As soon as all of the rods 10 of the array carried by the movable platform 7 has been filled, a release element resetting system 93 (FIG. 13) may be actuated to successively restore the operated release elements 60 into their original positions shown in FIG. 10, so that the jaw assembly 57 can then be oprated to deposit a new layer of wound spools onto the rods 10. For this purpose, the resetting assembly 93 operates, in response to a signal actuating an electromagnet 94, to pivot a lever 95, supported on pivot 96, against the force of a tension spring 97. Such motion serves to move an arm 98 of a two-armed lever coupled to the lever 95 in a counterclockwise direction and into alignment with a control pin 80 extending from a reversing lever 79, such lever 79 being similar to the pressure lever 70 of the jaw operating mechanism of FIG. 10. The lever 79, which is individual to and located behind the operating lever 70 of the associated jaw assembly 57, is moved from a first inoperative position shown in solid lines in FIG. 13 to a second operated position shown in dotted lines in the left portion of the figure upon an engagement of the control pin 80 with the arm 98. In the operated position shown in FIGS. 14 and 15, the control pin 80 is movable into engageable relation with the upper portion of an inclined surface 700 of the releasing element 60 while such element is in its operated position. Upon an engagement of the pin 80 with the surface 700, the release element 60 is swung back in a counterclockwise direction as shown in FIG. 16 into its starting position, wherein the detect 60a is again in intercepting relation with the control pin 71 (FIG. 10) of the pressure lever 70 coupled to the next-succeeding jaw arrangement 57.

Figure 18:
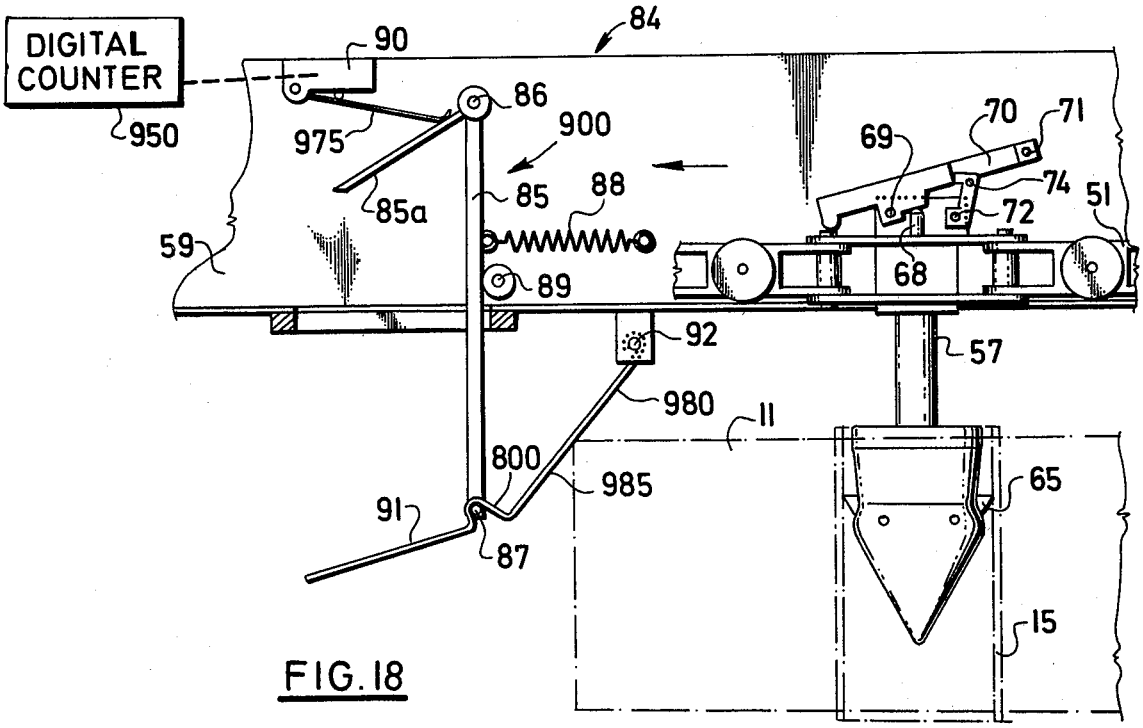
FIG. 18 is an elevation view of a sensor positionable within the portable arrangement of FIG. 1 for registering the number of acceptable spools which are transferred within the arrangement.

The device of FIG. 18 is adapted to register the number of "acceptable" spools 15 which are moved along the conveyor 51 by the jaw elements 57. The registering facility, represented at 84 in FIG. 18, includes an elongated sensing element 91 which is connected at one end to a pivot 92 affixed to a stationary guide surface 59 which bounds one side of the path of movement of the conveyor 51. An intermediate bent point 800 of the sensor 91 is normally engaged by a pin 87 at the bottom of a first arm 85 of a two-arm lever 900, such lever being fulcrumed at 86 and including a second arm 85a normally situated adjacent a terminal switch 90. Such switch 90 is arranged to actuate a register 950, illustratively a digital counter, each time the arm 85a is moved in a clockwise direction to engage a feeler element 975 of the switch 90.

When the pin 87 is engaged by the sensor 91 as shown, the arm 85 is maintained in a position against a resilient stop 89.

Upon an engagement of a portion 980 of the sensor 91 by an edge 985 of a captured yarn winding 11 as the conveyor 51 moves to the left as viewed in FIG. 18, the sensor 91 will impart a clockwise motion to the arm 85, thereby bringing the arm 85a into engagement with the feeling element 975. As a result, the terminal switch 90 will increment the register 950. After the passage of the winding 11 through the apparatus, a tension spring 88 will return the arm 85 to its original position in the path of the next-succeeding spool 11.

Advantageously, a common motor 101 (FIG. 7) can serve as a common drive for the driving wheel 37 of the conveyor 35, as well as the drive pulley 52 of the conveyor 51.

After the servicer 6 has received all of the wound spools 15 from one or more of the conveyors in the path illustrated in FIG. 1, the servicer can be unloaded by removing the unacceptable spools from the auxiliary magazine 22, and by rolling the movable platform 7 with the acceptable spools off the housing portion 6a of the servicer 6 for further processing.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a portable arrangement for collecting and automatically sorting wound spools from an open-end spinning machine having an exit point for successively discharging the wound spools, the arrangement comprising, in combination, a main housing supported for movement past the exit point, an entry chute affixed to the housing for receiving the successive spools from the exit point, the entry chute having a lower guiding edge against which an outer periphery of each received spool bears during movement thereof to the outlet end of the entry chute, first conveying means supported in the housing, an auxiliary magazine supported in the housing, classifying means disposed opposite the outlet end of the entry chute for directing spools having a wound diameter less than a predetermined value to the auxiliary magazine and for directing the remaining spools onto the first conveying means, an auxiliary support floor movably carried in the housing, a plurality of spool-receiving receptacles extending upwardly in horizontally spaced relation from the auxiliary support floor in a prescribed regular pattern, second conveying means movably supported in the housing for horizontal movement in a first path extending successively past the upper ends of the receptacles, means interposed in the housing between the first and second conveying means for successively transferring spools from the first conveying means onto spaced points of the second conveying means, and means individually associated with the receptacles and disposed in the path of movement of the second conveying means for successively releasing spools carried on the spaced portions of the second conveying means onto successive ones of the underlying receptacles.

2. An arrangement as defined in claim 1, in which the classifying means comprises wedge means having a vertex positioned opposite the outlet end of the entry chute, the wedge being positioned in transversely spaced relation to the guiding edge of the entry chute.

3. An arrangement as defined in claim 1, in which the first conveying means comprises, in combination, a first endless belt having a spool inlet point opposite the classifying means and a spool outlet point downstream thereof, blocking means disposed at the spool inlet point for normally inhibiting further passage of a spool, the blocking means being operable into a position out of the path of movement of the spool, sensing means normally actuable when the spool has reached the inlet point for operating the blocking means, and means rendered effective upon the occurrence of a predetermined condition for inhibiting actuation of the sensing means.

4. An arrangement as defined in claim 3, in which the transfer means comprises, in combination, third conveying means, and inertial means pivotally disposed at the inlet point of the first coveying means downstream of the blocking means and cooperable with an inlet point of the third conveying means for positioning spools passing the blocking means onto the third conveying means.

5. An arrangement as defined in claim 4, in which the transfer means further comprises, in combination, spool gripping means pivotally connected to spaced points along the second conveying means, and means rendered effective when the spool gripping means move past the outlet point of the third conveying means for engaging spools previously positioned at the inlet point by the inertial means.

6. An arrangement as defined in claim 5, in which the third conveying means has said outlet point disposed below and in alignment with the first path of the second conveying means, and in which the transfer means further comprises means disposed at the inlet point of the third conveying means for successively lifting spools conveyed to the inlet point of the third conveying means onto an overlying one of the spaced points of the second conveying means.

7. An arrangement as defined in claim 6, in which the second conveying means further comprises, in combination, a plurality of jaw means individually disposed at the spaced points along the second conveying means and cooperable with the lifting means, each jaw means being operable from a first normal spool-engaging position to a second spool-releasing position, and feeler means individually associated with each jaw means and engageable by the release means during movement of the second conveying means along the first path for operating the jaw means to discharge the engaged spool onto an underlying one of the receptacles.

8. An arrangement as defined in claim 7, in which the release means comprises a pivotally mounted arm normally disposed in a first position in the path of movement of the feeler means and responsive to engagement by the feeler means for movement into a second position out of the path of movement of a succeeding one of the feeler means.

9. An arrangement as defined in claim 8, in which the second conveying means further comprises, in combination, jaw resetting means including lever means disposed behind each feeler means and operable into an active position engageable with the pivotally mounted arm of the release means when such arm is in the second position for moving such arm back into its first position.

10. An arrangement as defined in claim 9, in which the second conveying means further comprises means for operating the lever means into its active position.

* * * * *